US005347769A

United States Patent [19]

Dinsmore

[11] Patent Number: 5,347,769

[45] Date of Patent: Sep. 20, 1994

[54] ANTI-GRAFFITI DEVICE

[75] Inventor: David W. Dinsmore, Solana Beach, Calif.

[73] Assignee: Joyce Gangewer DBA Sea Coast Canvas & Awning Co., San Diego, Calif.

[21] Appl. No.: 93,264

[22] Filed: Jul. 15, 1993

[51] Int. Cl.[5] ..... E04B 1/72

[52] U.S. Cl. ..... 52/101; 47/24

[58] Field of Search ..... 47/23, 24, 25; 52/101; 119/52.3, 57.9

[56] References Cited

U.S. PATENT DOCUMENTS

| | | | |
|---|---|---|---|
| 86,382 | 2/1869 | Faries | 47/24 X |
| 574,305 | 12/1896 | Crawford | 52/101 |
| 1,353,404 | 9/1920 | Libby | 47/24 |
| 1,512,618 | 10/1924 | McDonald | 52/101 X |
| 2,999,479 | 9/1961 | Carder | 47/23 X |
| 4,435,931 | 3/1984 | Newbanks | 52/101 X |
| 4,637,164 | 1/1987 | Brown | 47/24 |

FOREIGN PATENT DOCUMENTS

| | | | |
|---|---|---|---|
| 205796 | 1/1909 | Fed. Rep. of Germany | 47/24 |
| 490228 | 4/1919 | France | 47/24 |
| 596093 | 10/1925 | France | 52/101 |
| 14907 | 1/1926 | Netherlands | 47/24 |
| 35194 | 7/1913 | Sweden | 52/101 |

*Primary Examiner*—Carl D. Friedman
*Assistant Examiner*—Kevin D. Wilkens
*Attorney, Agent, or Firm*—Brown, Martin, Haller & McClain

[57] ABSTRACT

A guard device is designed to be fitted around a signpost to provide a barrier against persons attempting to climb the signpost. A pair of mating guard members each have a mating edge for engagement with the mating edge of the other guard member, and the mating edges each have a central recess forming an opening with the other recess for fitting around a signpost. Fastener devices such as bolts secure the guard members together with the opening in gripping engagement with the signpost. The guard members when secured together form a continuous barrier surface projecting outwardly from the signpost.

7 Claims, 1 Drawing Sheet

ANTI-GRAFFITI DEVICE

BACKGROUND OF THE INVENTION

The present invention relates to a device for inhibiting graffiti artists from gaining access to freeway or highway signs via the signpost.

Graffiti artists who deface signs with spray paint and similar materials pose a major problem to city and other authorities who must clean the signs repeatedly. The cost of cleaning graffiti defaced signs is enormous and growing rapidly. The cost borne by one city in California to clean graffiti from highway and freeway signs is currently more than $10,000 monthly.

SUMMARY OF THE INVENTION

It is an object of the present invention to provide a device for deterring or preventing graffiti artists from gaining access to signs via signposts, thus reducing the graffiti problem and resultant expense of cleaning defaced signs.

According to the present invention, a guard device for impeding access to signs via signposts is provided, which comprises a pair of guard members each having a mating edge for engagement with a corresponding mating edge of the other guard member, each mating edge having a central recess for cooperating with the central recess on the other edge to form an opening for fitting around a signpost, and fastener devices for securing the guard members together with the opening in gripping engagement with the signpost, the guard members together forming a continuous surface projecting transversely outwardly from the signpost to form a barrier against persons climbing the signpost.

Preferably, each guard member is substantially semicircular in shape and is made of sheet metal or similar material. The opening may be circular or of other shapes, depending on the cross-sectional shape and dimensions of the signpost with which it is to be used. A downwardly depending flange or collar preferably projects downwardly from the edge of the recess in each guard member, to form an extended gripping collar for fitting around the signpost when the two members are secured together. Downwardly depending fastener flanges are provided on the mating edges of the guard members, one on each side of the recess, with openings for receiving fasteners such as attachment bolts.

In a preferred embodiment of the invention, the dimensions of the recesses are such that there will be a small gap between the opposing mating edges of the guard members when they are fitted around the signpost. When the attachment bolts are tightened to clamp the parts together, the recesses flanges will be drawn inwardly to clamp against the signpost and the sheet metal guard members will be flexed slightly into a slightly conical shape.

The diameter of the guard members will be sufficient to provide an adequate deterrent to persons attempting to climb the signpost.

This invention provides an easy to install, inexpensive device for deterring graffiti artists. Such individuals will typically not have the necessary tools for removing the guard members from the signpost, and will be unable to climb the signpost with the guard members in the way. The incidence of graffiti on protected signs will be reduced, if not eliminated, substantially reducing expense to transportation authorities responsible for cleaning and maintaining such signs.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
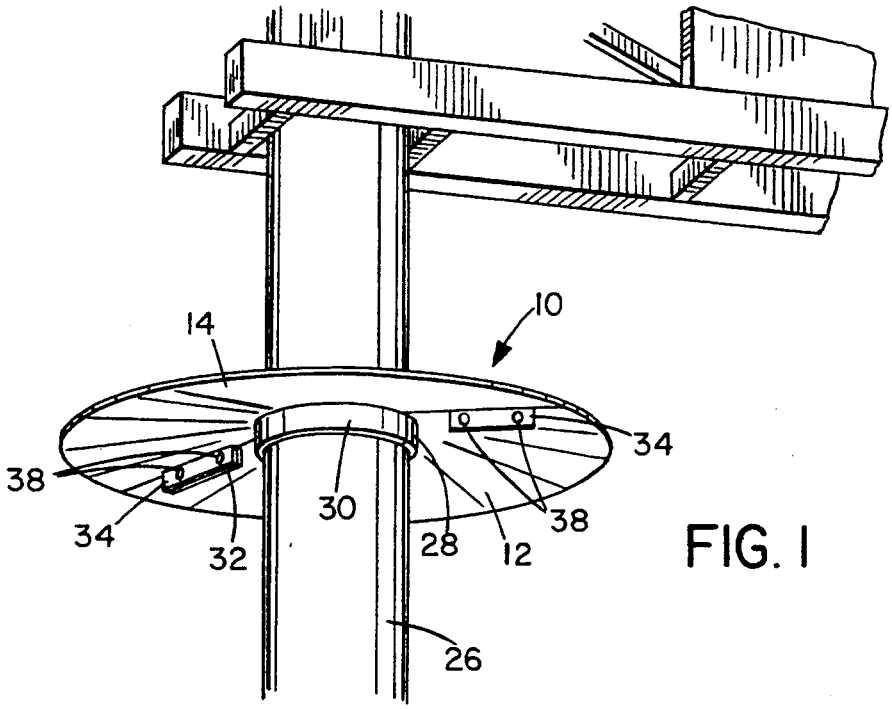
FIG. 1 illustrates a guard device according to a preferred embodiment of the invention attached to a billboard pole.
Figure 2:
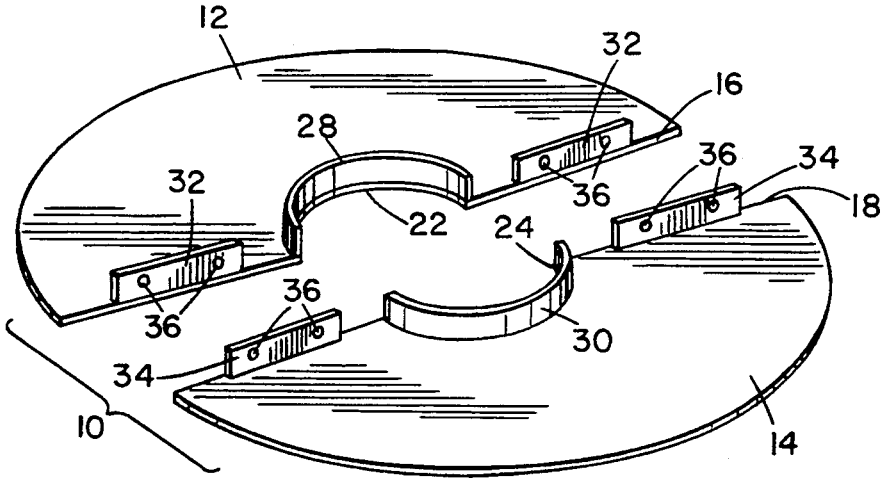
FIG. 2 is a perspective view of the underside of the two components of the guard.
Figure 3:
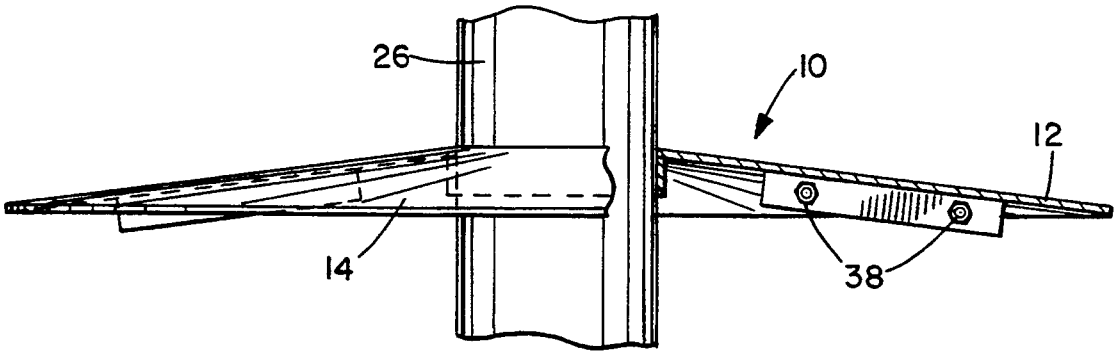
FIG. 3 is an enlarged side elevation view, partially cut away, of the mounted guard.

FIGS. 1–3 illustrate a guard device 10 for deterring graffiti on signs according to a preferred embodiment of the invention. As best illustrated in FIG. 2, the guard device 10 is made in two plates or guard members 12,14 each of which has a substantially straight mating edge 16,18 for engagement with the corresponding edge of the other guard member when the members are secured together. Each edge 16,18 has a central, arcuate recess 22,24 which coincides with the recess in the other edge when the two members are secured together to form an opening for fitting around a signpost 26 so that the guard members project transversely outwardly from the signpost to form a continuous barrier surface, as illustrated in FIGS. 1 and 3.

In the preferred embodiment of the invention, each guard member is a generally semi-circular piece of sheet metal, such as 16 gauge galvanized sheet steel, with a semicircular central opening forming recess 22,24, respectively. However, other shapes may be used both for the outer periphery of the guard member and for the recesses 22,24, with the shape and dimensions of recesses 22,24 being determined by the shape and dimensions of the signpost around which they are to be fitted. The recesses may form a circular opening to fit around a cylindrical signpost, as illustrated, or may form a square opening where a signpost is of square cross-section.

The guard members are designed to form a continuous barrier surface or collar projecting outwardly from a signpost when secured in place. An arcuate flange or collar 28,30 projects downwardly from each of the recesses 22,24 to form a continuous tubular sleeve surrounding the signpost. Flanges 28,30 are preferably of sheet metal and are suitably welded to the undersurface of the sheet steel members 12,14, as best illustrated in FIG. 2. A pair of attachment flanges 32,34 is provided on the straight edge 16,18 of each of the guard members, with one attachment flange located on each side of the central recess. Each flange projects downwardly from the edge of the respective member and has a pair of openings 36 for receiving attachment bolts 38 when the two members are placed together with the attachment flanges in alignment, as illustrated in FIG. 3.

Preferably, the dimensions of the opening formed by mating recesses 22,24 are slightly less than the cross-sectional dimensions of the signpost 26. Because of this, there will be a small gap between the edges of the members when they are placed with their recesses engaged around opposite sides of a signpost. Preferably, the gap is of the order of $\frac{5}{8}$-inch. In order to install the guard device on a signpost, the two halves or members 12,14 are simply placed in alignment on opposite sides of the post, at the appropriate height. The guard device must be placed at a sufficient height on the post so that it cannot be reached by a person from the ground without climbing the post, i.e. well above the normal hand reach of the tallest individual. When the two members have been appropriately positioned, the attachment bolts 38 are engaged in the aligned openings 36 in the flanges 32,34, and tightened. The flanges 28,30 will be drawn inwardly against the signpost and will tend to grip the signpost securely. Also due to the tightening of the bolts 38, the sheet metal members 12,14 will be deformed into a slightly conical shape, as best illustrated in FIG. 3, having a curvature of around 2 inches.

The outer diameter of the members 12,14 is designed to be sufficient to deter anyone from attempting to climb the signpost. Preferably, the members 12,14 have an outer diameter of at least 60 inches. The diameter of opening formed by recesses 22 and 24 will be dependent on the diameter of the signpost around which it is to be fitted and will typically be in the range from 14" to 20" while the flanges 28 and 30 are around 3" in depth. Flanges 32 and 34 may be 2" by 2" angle flanges with one face welded to the undersurface of the respective guard member 12,14 at edge 16,18 respectively. This arrangement will provide a barrier to anyone climbing the post which is wide enough to prevent anyone from climbing around it.

This two-piece guard device can be bolted tightly around any signpost supporting a sign or billboard in a graffiti-prone area without needing to drill or weld the signpost itself. Installation is quick and easy. The product when installed is simple and unobtrusive in appearance, and is therefore virtually unnoticeable except to would-be vandals. The device is relatively inexpensive both in manufacture and installation costs, and will deter or eliminate graffiti and the resultant costs of cleaning such graffiti from roadside signs and other billboards.

Although a preferred embodiment of the invention has been described above by way of example only, it will be understood by those skilled in the field that modifications may be made to the disclosed embodiment without departing from the scope of the invention, which is defined by the appended claims.

I claim:

1. A guard device for impeding access to signs via signposts, comprising:

a pair of guard members each comprising a semi-circular, substantially flat sheet member having a straight mating edge for engagement with the corresponding straight mating edge of the other guard member to form a substantially continuous guard surface;

each mating edge having a central recess for alignment with the central recess in the mating edge of the other guard member to form a circular opening for fitting around a signpost;

each recess having a semi-cylindrical flange projecting downwardly from said recess in a direction transverse to said guard surface, the flanges cooperating when the guard members are secured together to form a generally cylindrical collar, said collar comprising means for gripping engagement with a signpost; and securing means for securing the guard members together with the opening and collar in gripping engagement with the signpost and the guard surface formed by the members projecting outwardly from the signpost in a generally radial direction to form a barrier against persons climbing the signpost.

2. The device as claimed in claim 1, wherein the opening is of smaller dimensions than the cross-sectional dimensions of a signpost around which it is to be fitted.

3. The device as claimed in claim 1, wherein said members have an outer diameter of at least 60 inches.

4. The device as claimed in claim 1, wherein said members are of sheet metal.

5. The device as claimed in claim 1, wherein said members form a slightly conical shape with said opening at the center.

6. The device as claimed in claim 1, wherein each guard member has a pair of attachment flanges each projecting downwardly from the straight mating edge of said member at a location spaced from said semi-cylindrical flange, one of said attachment flanges of each member being located on one side of said semi-cylindrical flange and the other attachment flange being located on the other side of said semi-cylindrical flange, said attachment flanges having openings which are aligned when the members are secured together in mating engagement, said securing means comprising fastener means for extending through said openings.

7. A guard device for impeding access to signs via signposts, comprising:

a pair of guard members each comprising a sheet member having a straight mating edge for engagement with the corresponding mating edge of the other guard member to form a substantially continuous guard surface;

each mating edge having a central recess for alignment with the central recess in the mating edge of the other guard member to form an opening for fitting around a signpost;

securing means for securing the guard members together with the opening in gripping engagement with the signpost and the guard surface formed by the members projecting outwardly from the signpost to form a barrier against persons climbing the signpost; and a pair of attachment flanges projecting downwardly from the straight mating edge of each of said guard members at locations spaced from said recess, one of said attachment flanges being located on one side of said recess and the other attachment flange being located on the other side of said recess, said attachment flanges having openings which are aligned when said members are secured together, said securing means comprising attachment bolts for extending through said aligned openings.

* * * * *